United States Patent [19]

Hillberg et al.

[11] 4,392,320

[45] Jul. 12, 1983

[54] TRIGGER RETAINING AND STABILIZING MEANS

[76] Inventors: Robert L. Hillberg, 26 Mount Sanford Rd., Cheshire, Conn. 06410; Frederick F. Stevens, 177 Brett Rd., Fairfield, Conn. 06430

[21] Appl. No.: 373,263

[22] Filed: Apr. 29, 1982

[51] Int. Cl.[3] ..... F41C 17/00

[52] U.S. Cl. ..... 42/69 R

[58] Field of Search ..... 42/69 R, 69 A, 69 B, 42/7

[56] References Cited

U.S. PATENT DOCUMENTS

| | | | |
|---|---|---|---|
| 965,661 | 7/1910 | Schrader | 42/7 |
| 1,320,578 | 11/1919 | Savage | 42/7 |
| 1,395,455 | 11/1921 | Searle | 42/7 |
| 1,521,286 | 12/1924 | Fisher | 42/69 R |
| 2,942,369 | 6/1960 | Emanuel | 42/7 |

*Primary Examiner*—Charles T. Jordan
*Assistant Examiner*—Ted L. Parr
*Attorney, Agent, or Firm*—McCormick, Paulding & Huber

[57] ABSTRACT

The trigger of a handgun is retained and stabilized for longitudinal sliding movement between ready and firing positions within an upwardly opening guideway in the gun frame by longitudinally spaced apart lugs which project from the trigger into a guide track formed in the frame and opening laterally into the guideway. When the trigger is in an assembly position relative to the frame one of the lugs is vertically aligned with an upwardly and laterally inwardly opening notch in the frame which communicates with the guideway and the guide track. A pin carried by the trigger and engageable with an abutment on the frame prevents movement of the trigger to its assembly position after assembly with the frame.

11 Claims, 8 Drawing Figures

TRIGGER RETAINING AND STABILIZING MEANS

BACKGROUND OF THE INVENTION

This invention relates in general to firearms and deals more particularly with means for retaining a trigger in assembly with a gun frame and stabilizing it for smooth sliding movement relative to the frame. The present invention is particularly concerned with an improved trigger for a derringer type pistol which has a frame including a hollow pistol grip containing a firing mechanism, which is normally assembled with the gun frame through an opening in a side of the pistol grip. In a handgun of the aforesaid type, the trigger is supported by ways formed in the frame. One of the ways is usually defined, at least in part, by a portion of the trigger guard. Generally, the trigger must be dimensioned to pass through an opening in the side of the pistol grip, so that it may be inserted into the ways. This dimensional limitation necessitates relatively short slide surfaces on the trigger. Such a "short" trigger has a tendency to bind in the ways. Hard trigger pull must be exerted to overcome this binding action. Further, a short trigger tends to be unstable. Accumulated tolerances or wear may result in slight rocking motion of the trigger within the ways. In a gun of the type wherein a sear carried by the hammer and engaged with the trigger releases upon movement of the trigger to a predetermined firing position, excessive trigger play may cause serious operational problems. Such excessive trigger play may, for example, cause premature hammer release resulting in misfire. The present invention is concerned with the aforementioned problems.

SUMMARY OF THE INVENTION

The present invention is concerned with improvement in a gun of the type which has a frame, a trigger, and means supporting the trigger for reciprocal sliding movement between ready and firing positions within a guideway formed in and extending longitudinally of the frame. In accordance with the invention the trigger supporting means comprises a longitudinally extending guide track defined by the frame and communicating with the guideway and a notch formed in the frame and communicating with both the guideway and the guide track. A pair of spaced apart guide elements which project from the trigger into the guide track retain the trigger in assembly with the frame and stabilize it for movement relative to the frame. The trigger has an assembly position wherein one of the guide elements is aligned with the notch and the trigger is free to move into and out of assembly with the frame.

DETAILED DESCRIPTION OF PREFERRED EMBODIMENT

Figure 1:
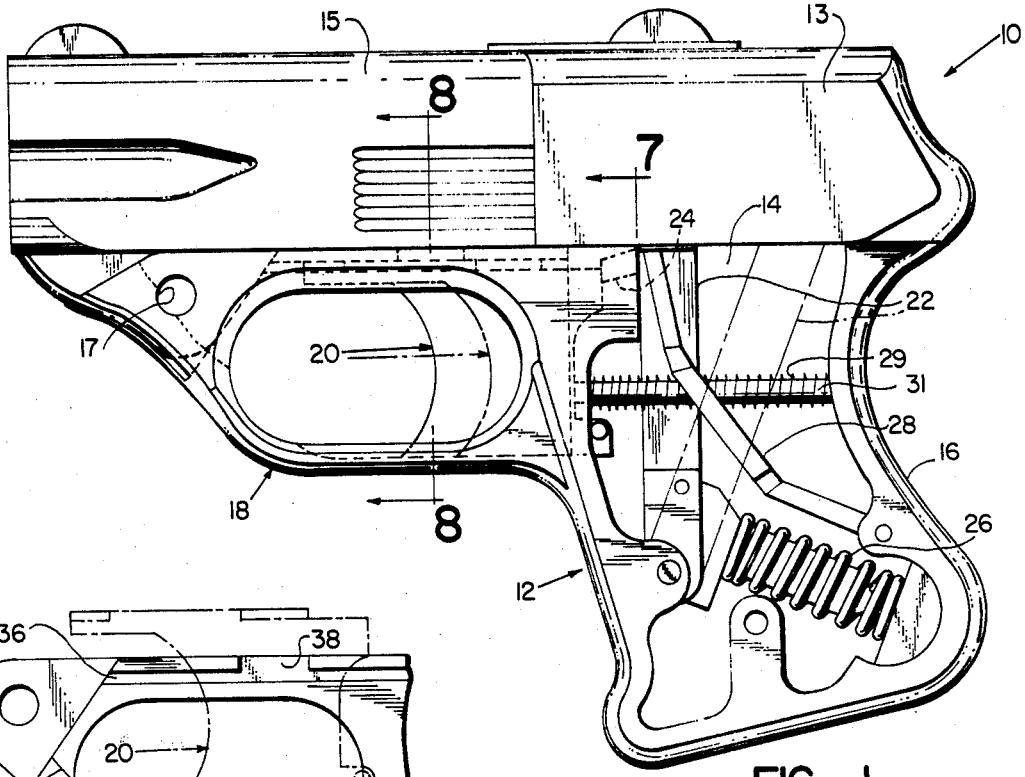
FIG. 1 is a side elevational view of a pistol embodying the present invention shown with one grip panel removed to reveal structure therebehind.

Referring now to the drawing, a multi-barrel, breech loaded handgun or pistol having a trigger and associated trigger supporting structure embodying the present invention is indicated generally by the reference numeral 10. The pistol 10 has a frame indicated generally at 12, which includes a receiver 14, a breech 13, a pistol grip 16, and a trigger guard designated generally by the numeral 18. A barrel assembly 15 is connected to the forward end of the frame by a pivot pin 17 to break upward and away from the breech for loading and ejecting cartridges, in a manner well known in the art. The gun 10 has a double acting firing mechanism which includes a trigger indicated generally at 20, supported on the frame for reciprocal sliding movement between ready and firing positions, respectively indicated by full and broken lines in FIG. 1.

The firing mechanism includes a hammer assembly which has a hammer 22 supported within the pistol grip 16 for pivotal movement between a firing position in firing relation to an associated cartridge and a releasing position, indicated by broken lines in FIG. 1. A sear 24 carried by the hammer 22 is engageable with the trigger 20 in its ready position and moves the hammer to its releasing position in opposition to the biasing force of a mainspring 26 and in response to movement of the trigger from its ready to its firing position. When the trigger reaches its firing position the sear 24 disengages from the trigger 20 allowing the mainspring 26 to urge the hammer assembly toward its firing position. A rotary firing element (not shown) mounted on the upper end of the hammer 22 is sequentially indexed to successive firing positions by a ratchet and pawl mechanism which includes a pawl 28. The firing mechanism also includes a trigger spring assembly, which comprises a trigger spring 29 and a spring guide rod 31, for biasing the trigger toward its ready or full line position of FIG. 1.

Further disclosure of a handgun which has a firing mechanism of the type hereinbefore described is found in the co-pending U.S. patent application of Robert L. Hillberg for HANDGUN, Ser. No. 111,870, filed Jan. 14, 1980, and assigned to COP, Inc., Torrance, Calif., which is hereby adopted by reference as part of the present disclosure. The present invention resides in the construction of the trigger and the manner in which it is supported in and retained in assembly by the frame, which will hereinafter be considered in somewhat further detail.

Figure 3:
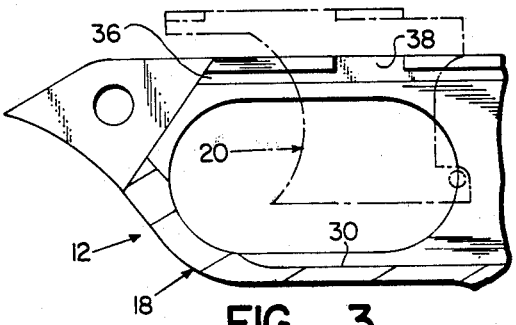
FIG. 3 is a fragmentary sectional view taken along the line 3—3 of FIG. 2 and shows the trigger in phantom and aligned for assembly with the frame.
Figure 2:
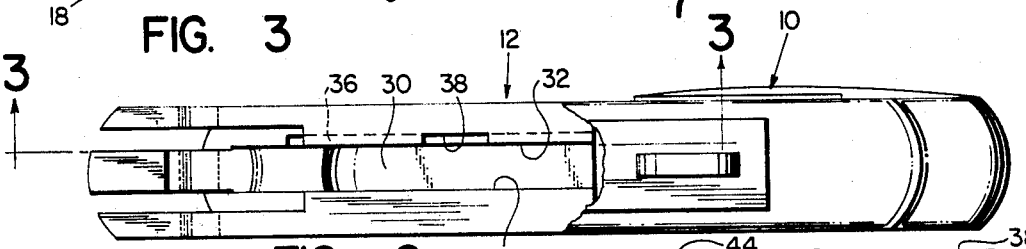
FIG. 2 is a plan view of the pistol of FIG. 1 shown with the barrel assembly removed and a portion of the breech broken away.
Figure 8:
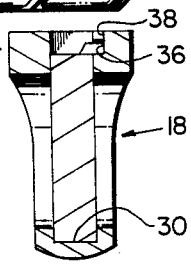
FIG. 8 is a fragmentary sectional view taken along the line 8—8 of FIG. 1.

Referring particularly to FIGS. 1 and 2, the frame 12 has an upwardly opening slot 30 defined by opposing side walls 32 and 34, which forms a guideway for the trigger 20. The slot 30 communicates with the opening in the trigger guard 18 and extends into the lower portion of the trigger guard, as best shown in FIGS. 3 and 8. A forwardly and inwardly opening groove or guide track 36 formed in the upper portion of the frame, extends longitudinally of the frame, opens through the side wall 32, and communicates with the slot 30 and the hollow interior of the pistol grip 16. A notch 38 formed in the upper portion of the frame 12, and spaced rearwardly from the front end of the frame, communicates with the guide track 36 and the slot 30 for a purpose which will be hereinafter further discussed.

Figure 4:
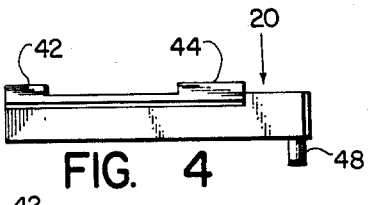
FIG. 4 is a plan view of the trigger.
Figure 7:
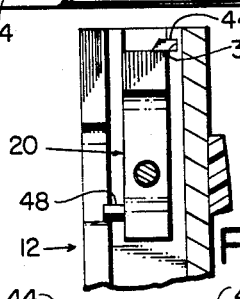
FIG. 7 is a fragmentary sectional view taken along the line 7—7 of FIG. 1.
Figure 5:
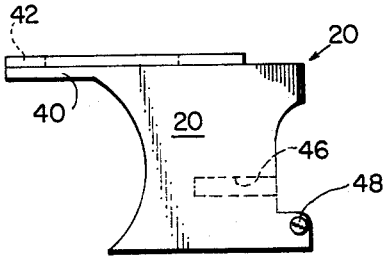
FIG. 5 is an elevational view and shows one side of the trigger.
Figure 6:
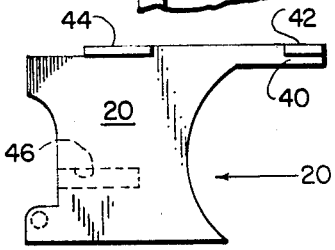
FIG. 6 is an elevational view of the other side of the trigger.

The trigger 20, best shown in FIGS. 4–6, has a rectangular portion, which includes a forwardly facing arcuate finger grip. It has an integral forwardly projecting extension 40 at its upper end and includes a pair of longitudinally disposed and spaced apart guide elements or lugs 42 and 44 which project laterally from one side of the trigger at its upper end. The lugs 42 and 44 are received in assembly within the guide track 36. A blind bore 46 formed in the lower portion of the trigger opens through its rear end for receiving the trigger spring 29 and its associated guide rod 31, best shown in FIG. 1.

In the illustrated pistol 10 the trigger 20 is assembled with the frame 12 before the barrel assembly 15 is pivotally secured to the frame. The lower portion of the trigger 20 is inserted downwardly into the slot 30 and the trigger is moved to an assembly position wherein the lug 44 is vertically aligned above the notch 38. Referring to FIG. 3, wherein the trigger is shown in phantom and in an assembly position, it should be noted that the lug 42, at the forward end of the trigger, is located forward of an associated front portion of the frame 12. When the trigger 20 is aligned with the frame in the aforedescribed position the lug 44 is free to pass downwardly through the notch 38 and the lug 42 is free to move downwardly past the associated front portion of the frame to a position wherein the lug 44 is disposed within the guide track and the lug 42 is longitudinally aligned with the forward end of the guide track 36. The lower marginal portion of the trigger 20 moves into the portion of the slot 30 defined by the lower part of the trigger guard 18. The trigger spring 29 and guide rod 31 may now be inserted through the side opening in the pistol grip 16 and into the blind bore 46. After the trigger spring and guide rod have been properly positioned relative to the frame the trigger 20 is drawn back against the biasing force of the trigger spring. While the trigger is held in its drawn back position a pin 48 is forcibly inserted into a hole provided in the trigger for this purpose to complete the trigger assembly. The pin 48 is arranged to engage an associated abutment surface on the frame 12 to limit forward movement of the trigger and retain it in a position wherein both of the lugs 42 and 44 are disposed within the guide track 36.

Upon completion of the trigger assembly the barrel assembly may be pivotally secured to the frame by the pivot pin 17. The aforedescribed procedure simplifies assembly of the trigger, trigger spring and trigger spring guide rod. The forwardly extending portion of the trigger facilitates provision of relatively widely spaced lugs which cooperate with the guide track to stabilize the trigger and assure smooth trigger action without risk of binding. Thus, more convenient trigger assembly and improved trigger action results.

We claim:

1. In a gun having a frame and a trigger supported in assembly in a guideway defined by the frame for reciprocal movement longitudinally of the frame between ready and firing positions the improvement comprising said frame having a longitudinally extending guide track communicating with said guideway and at least one opening communicating with said guideway and said guide track, said trigger having longitudinally spaced apart guide elements slidably received within said guide track and retaining said trigger in assembly with said frame within said guideway, said trigger having an assembly position relative to said frame wherein one of said guide elements is aligned with said one opening for movement through said one opening and said trigger is free to move into and out of assembled relation with said frame.

2. In a gun as set forth in claim 1 the further improvement wherein said guideway comprises an upwardly opening slot in said frame.

3. In a gun as set forth in claim 2 the further improvement wherein said slot is defined by opposing laterally spaced apart guide surfaces and said guide track comprises a groove opening laterally into said guideway through one of said guide surfaces.

4. In a gun as set forth in claim 3 the further improvement wherein said frame has a pistol grip at its rear end and said slot opens through the front end of said frame.

5. In a gun as set forth in claim 4 the further improvement wherein another of said guide elements is disposed forwardly of an associated front end portion of the frame when said trigger is in its assembly position.

6. In a gun as set forth in any one of claims 1 through 5 the further improvement wherein said one opening comprises a notch opening upwardly through said frame.

7. In a gun as set forth in claim 6 the further improvement wherein said notch opens laterally inwardly into said guideway.

8. In a gun as set forth in any one of claims 1 through 5 the further improvement wherein said assembly position is located in one longitudinal direction beyond said ready position and said firing position.

9. In a gun as set forth in any one of claims 1 through 5 the further improvement wherein said ready position is located intermediate said assembly position and said firing position.

10. In a gun as set forth in any one of claims 1 through 5 the further improvement wherein said gun includes means for preventing movement of said trigger to its assembly position when said gun is in its assembled condition.

11. In a gun as set forth in claim 10 the further improvement wherein said means for preventing movement comprises a pin carried by said trigger and engageable with an abutment surface on said frame.

* * * * *